United States Patent [19]

Siryj

[11] 4,371,246

[45] Feb. 1, 1983

[54] THERMAL PROCESSOR

[75] Inventor: Bohdan W. Siryj, Cinnaminson, N.J.

[73] Assignee: RCA Corporation, New York, N.Y.

[21] Appl. No.: 234,595

[22] Filed: Feb. 13, 1981

[51] Int. Cl.[3] ..... G03D 7/00

[52] U.S. Cl. ..... 354/299; 354/300; 219/216; 219/373; 219/388

[58] Field of Search ..... 354/297, 299, 300, 83; 219/216, 388, 373

[56] References Cited

U.S. PATENT DOCUMENTS

| | | | |
|---|---|---|---|
| 3,496,332 | 2/1970 | Lunde | 354/299 |
| 3,585,917 | 6/1971 | Griffith | 354/297 |
| 3,850,635 | 11/1974 | Leavitt | 354/299 |
| 4,052,732 | 10/1977 | Meadows | 354/297 |
| 4,148,575 | 4/1979 | Siryj | 354/300 |
| 4,198,145 | 4/1980 | Scott | 354/299 |
| 4,293,212 | 10/1981 | Siryj et al. | 354/300 |

*Primary Examiner*—L. T. Hix
*Assistant Examiner*—Alan Mathews
*Attorney, Agent, or Firm*—Samuel Cohen; William Squire

[57] ABSTRACT

A length of photographic film being developed by heat is supported on a fluid bearing by heated air which passes through two porous elements which serve as the walls of the film path. The air is preheated and the porous elements themselves are separately heated within and beyond the film passageway in order further to raise the temperature of the air bearing. The edges of the path are heated to a higher temperature than the center of the path to thereby compensate for edge effects at the film. The added heat at the edges of the path provide more uniform heating of the film across the width dimension of the film.

8 Claims, 7 Drawing Figures

Fig. 4
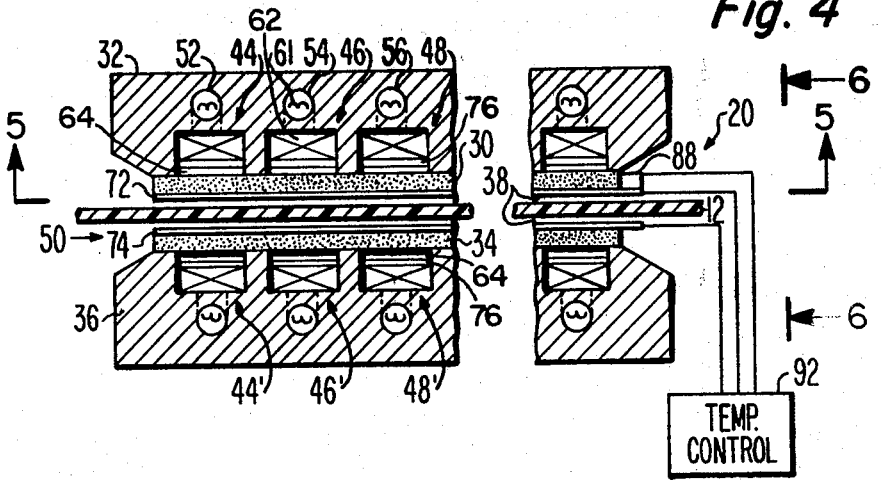
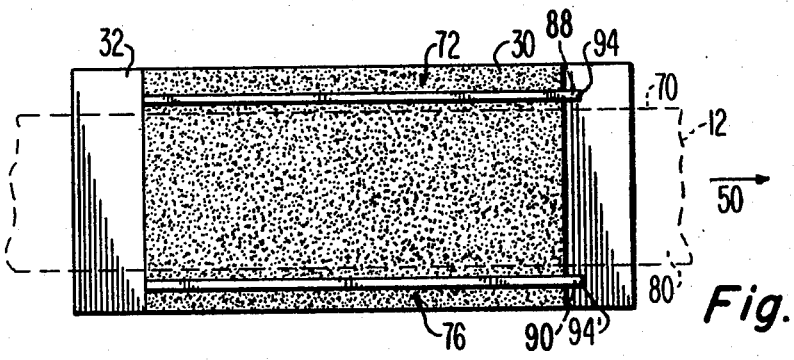
Fig. 5
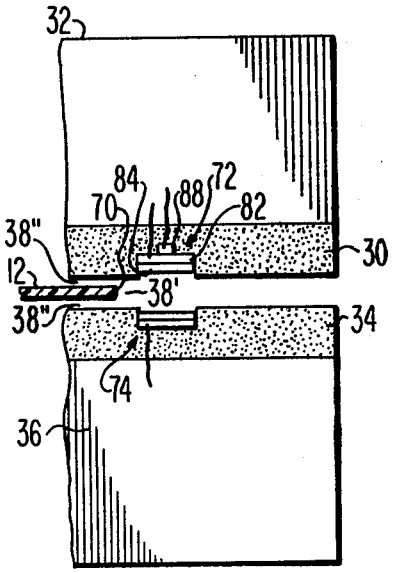
Fig. 6
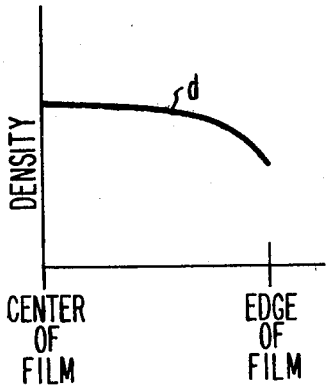
Fig. 7

THERMAL PROCESSOR

The present invention relates to an apparatus for uniformly heating strip material, such as a film being developed by heat, as it passes along a path.

For background, the reader is referred to U.S. Pat. Nos. 4,198,145 and 4,148,575 and copending U.S. application Ser. No. 790,662, entitled "Apparatus for Developing Photographic Images on an Emulsion Coated Film," filed Apr. 25, 1977 by Richard David Scott, all assigned to the same assignee as the present application, now U.S. Pat. No. 4,293,212. U.S. Pat. No. 4,148,575 is incorporated by reference herein.

The present invention is particularly useful in a thermal processor for developing a strip of photographic film by heat. The film development is carried out by heating the film with a hot gas, such as hot air, which also supports the film as described, for example, in the aforementioned U.S. Pat. No. 4,148,575. In this patented system, the gas passes through a porous distribution means, such as one formed of porous graphite or ceramic, which is heated by elements next to the distribution means. This system provides highly satisfactory performance in many applications. However, it has been found that uneven heating of the film can occur during the transfer of the gas from the distribution means to the film as discussed later. For some applications, this reduces the quality of the developed film as will be discussed below, to a level lower than desired.

In apparatus embodying the invention, heated gas is applied to a strip of film as it travels along the length dimension of a path. To obtain more uniform heating of the film and to thereby reduce density variations in the developed film, the means for distributing the gas is heated not only over the width of the film but also beyond the edges of the film. The means for heating the gas slightly beyond the edges of the film is separately controllable relative to the means for heating the film over its width.

In the drawing:

FIG. 4 is a sectional side elevational view of the apparatus of FIG. 3 taken along lines 4—4;

FIG. 5 is a plan view taken along lines 5—5 of FIG. 4;

FIG. 6 is an elevation sectional view taken along lines 6—6 of FIG. 4; and FIG. 7 is a graph useful in explaining the invention.

Figure 1:
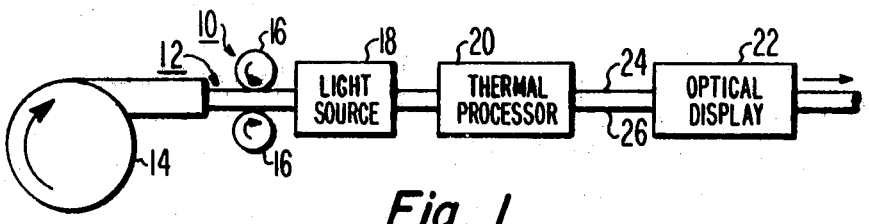
FIG. 1 is a schematic drawing of a photographic film developing apparatus embodying the present invention.

In FIG. 1 a photographic film 12 is fed from a supply cassette 14 into a film development apparatus 10 such as described in the above-identified application. Film 12 passes through a pair of drive rollers 16 which convey film 12 through apparatus 10. Film 12, photothermally sensitized as will be described subsequently, passes through a light source 18, preferably a confined laser beam. During the exposure to light from source 18, a latent image is recorded on film 12. The exposed film then passes through a suitable heat source within thermal processor 20, to develop a fixed photographic on the film. The thermal processor, to be described in detail below, may be used in any photographic system which utilizes heat-processing for image development and which does not require application of external liquid developing agents. The image may be visually displayed on an optical display 22. The logic employed in the laser beam recorder determines whether a positive or a negative image will be developed and displayed.

Figure 2:
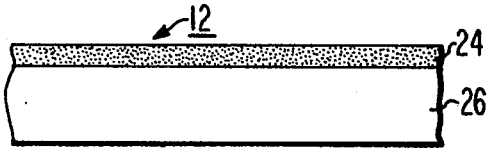
FIG. 2 is a fragmentary side elevation of a photographic film utilized in the apparatus of FIG. 1.

The photographic film 12, shown in FIG. 2, comprises a layer 24 of light sensitive and heat developable emulsion coated on a suitable base 26. Emulsion 24 may be a dry silver material comprising an oxidizing agent, such as a heavy metal salt, a reducing agent, and a photosensitive component such as photosensitive silver halide which serves as a catalyst for oxidation-reduction image forming combination comprising (i) silver behenate and/or silver stearate with (ii) a reducing agent, such as bis-beta-naphthol and photosensitive silver halide. Other suitable image producing emulsions may be used instead.

Emulsion 24 can be coated on a base 26 of a wide variety of materials according to usual practice. Typical base materials for photographic film include glass, metal, paper cellulose, triacetate, polyethylene terephthalate and film bases having high heat distortion temperatures suitable for providing a film support for heat-fixing image development.

Figure 3:
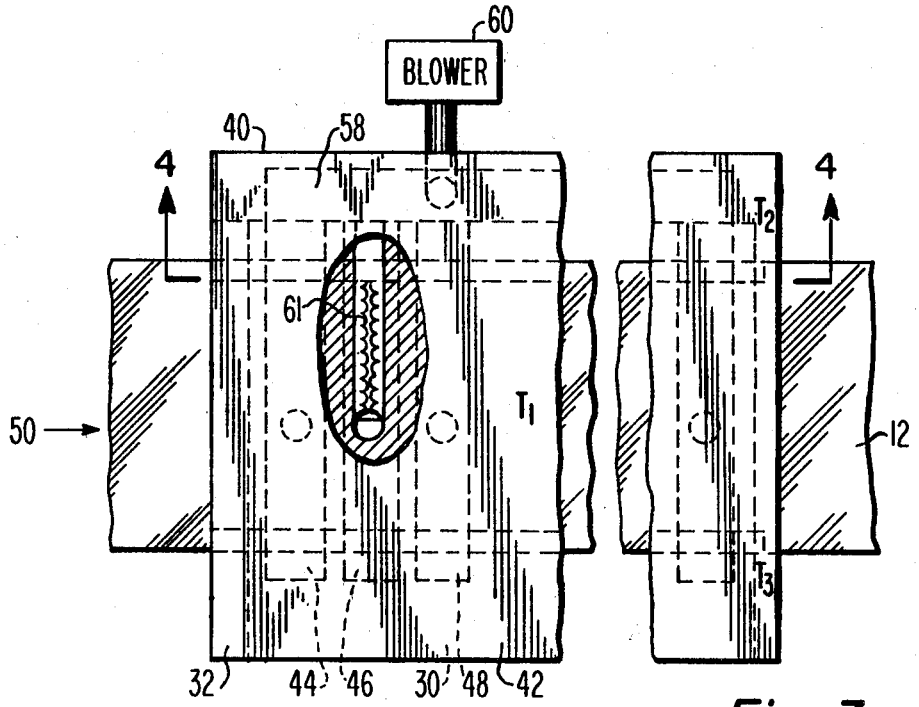
FIG. 3 is a fragmentary partially-sectioned plan view of the thermal processor embodying the present invention.

In FIGS. 3 and 4, which illustrate details of the thermal processor 20, planar porous members 30 and 34 are mounted to housings 32 and 36, respectively, the film 12 passing through a gap 38 between these members. The porous members 30 and 34 comprise sheets of homogeneous porous material, preferably graphite or ceramic material. Member 30 and housing 32 are mirror images of member 34 and housing 36. The housing 32 contains a plurality of heating modules 44, 46, 48 and so forth. Each of the heating modules 44–48 is mounted on porous member 30 and each of the heating modules 44'–48' is mounted in complementary fashion to member 34.

A typical module 46 is described in more detail in U.S. Pat. No. 4,148,575 mentioned above. The remaining modules are identical to module 46. Any number of modules may be mounted in housing 32 extending along the length of the path of the film 12 which travels in the direction 50. Film 12 is uniformly spaced from the members 30 and 34 with the emulsion side facing one of the members, for example, member 30, across a path width in a direction normal to direction 50.

In FIGS. 3 and 4, each of modules 44, 46, and 48, and so on is connected in gas communication with its corresponding inlet ducts 52, 54, 56 and so forth. The gas, which is pressurized air, is provided to inlet ducts 52, 54, 56 via distribution plenum cap 58 from blower 60. Cap 58 is a hollow housing form a plenum chamber in gas communication with each of the inlet ducts 52–56. Mounted in each of the ducts 52, 54, 56 and so forth are corresponding heaters 61 which are electrically connected for preheating air supplied to the ducts. Blower 60 provides pressurized air to each of modules 44, 46, and 48 via the ducts.

The air is supplied under pressure to the porous member 30 via the modules 44, 46, and 48. Member 30 is heated by the modules 44–48. The preheated air passing through the pores of the member 30 is additionally heated by the member 30 to a temperature sufficiently high to develop the latent image on film 12. The air provided by blower 60 is pressurized so that film 12 is supported by the flow of the air passing through the pores of members 30 and 34. This forms a gas bearing for the film such that the film does not directly contact either the members 30 or 34 as it travels in direction 50.

Module 46 includes a chamber 62 which is rectangular in cross-section and extends along the width of housing 32. Chamber 62 is in gas communication with duct 54 by a centrally vertically disposed duct. Chamber 62 is in gas communication with the porous member 30. Mounted in thermal conductive contact with the porous member 30 is slotted heat transfer plate 64 as described in U.S. Pat. No. 4,148,575.

A heater 76 is in thermal contact with the upper surface of the plate as described in U.S. Pat. No. 4,148,575. Mounted above the heater is a centrally located thermistor for providing suitable temperature control of the plate. A slotted resilient member (not shown) made of sponge rubber or other resilient material is mounted above and in contact with the heater to squeeze the heater and the plate against member 30. A pressure plate (not shown) is disposed directly above the member 80 for applying resilient pressure to the plate. All of the above elements are described in more detail in U.S. Pat. No. 4,148,575.

Each of the modules 44, 46 and so on extending along the length of gap 38 is individually thermally controllable for applying heat to the air at that respective module. That is, each of the heater elements (not shown) in each module has a separate control (not shown) for turning that heater on or off independent of the on or off state of the next adjacent module. However, the mirror image modules, for example, modules 44', FIG. 4, associated with module 44, module 46' associated with module 46, and module 48' associated with module 48 are operated together as a pair and are either on or off as a pair. A thermistor is in direct contact with the heater element thus assuring that the thermal response time is well within the bandwidth of the temperature controller (not shown). Bandwidth is defined as that temperature range at the temperature sensor causing the controller to change the average power in the heater from 0 to 100%. The number of pairs of modules in operation and the speed of the film determine the time duration the film is heated as it passes through the module sets. The processing temperature is determined by the film characteristics and film speed. Thus, a wide variety of films may be handled by a single thermal processor 20.

A problem with the system described so far is that it has been discovered that the optical density (ability to transmit light) of the developed film is not as uniform as desired for certain applications. The optical density for film processed by the processor just described is shown in FIG. 7. If the zero axis is considered the film center and the edge of the film (normal to direction 50, FIG. 3) is located at the position as shown, the optical density varies as shown by curve d. If the density of a film uniformly exposed to a given light intensity is developed, it may have a density of about 1, corresponding to a transparent condition, assuming the light is perfectly uniform and the film has a controlled emulsion uniformity. The system described above exhibits a density variation of about 0.1 at the film edges as seen in FIG. 7 which is exaggerated for illustration. Employing a contact thermal developer in which a heated roller is in conductive thermal contact with the film, the reported density variation is about 0.05. These variations, especially for a gas system, are more than desired for certain applications. Apparatus to be described is able to achieve substantially negligible density variation across the film width, i.e., a density variation of about 0.02 which is otherwise not considered possible with present thermal processors of the type described.

To achieve such a small variation in density the cause of the density variation of 0.10 as shown in FIG. 7 should be understood. It is believed that this variation in density is due to variations in heating the film. The film is not heated uniformly as desired as a result of non-uniform gas flow. These variations in gas flow are attributed to geometric discontinuity at the proximity of the edges of the film. As seen in FIG. 6, the gap 38' adjacent the film 12 edge 70 is substantially greater than the gaps 38" between the film 12 and the members 30 and 34. This sharp change in gap is believed to cause a gas flow variation which affects the film temperature at the film edges and thus affects the resultant density in the developed film. It must be remembered that while the members 30 and 34 are assumed uniformly heated by the heater modules described above gas flow variations around the film may affect the uniform heating of the film to the degree desired.

To overcome this problem, in accordance with the present invention, additional heater modules 72, 74 adjacent to film edge 70 are secured in respective members 30 and 34 and modules 76 and 78 (not shown), FIG. 5, are secured to respective members 30, 34 adjacent to film edge 80. The heater modules 72, 74, 76, and 78 extend the length of members 30, 34 in direction 50 and are positioned just beyond the edges 70 and 80 of the film, as shown in more detail in FIG. 6.

The modules 72, 74, 76, and 78 are identical except for the thermistors and only one module will be described in detail. Module 72, FIGS. 5 and 6, comprises a foil heater 82 and a highly thermally conductive sheet layer 84. Heater 82 is a heater element (foil resistor) embedded in a thermoplastic sheet and is commercially available. The sheet layer 84 may be a foil sheet of copper, in one example. The layer 84 overlies the heater 82. The heater 82 and thermal conductive layer 84 are both slightly recessed within member 30 to insure that opposing modules, such as 72 and 74, do not contact each other. Such recessing is desirable as the gap 38' is only about 8 mils thick.

In one example of the invention, module 72 is about ½ inch wide the film is about 9½ inches wide, and the members 30 and 34 are formed of graphite and are about 12 inches wide. The module 72 is spaced about ¼ inch from the edge of the film 12. The module 72 provides additional heat to member 30 at an area adjacent edge 70, FIG. 6. The temperature of module 72 and member 30 at this area need not be, and in fact, usually is not the same, as the remainder of member 30 in order to provide uniform density of the developed film. For this reason module pairs 72, 74 and 76, 78 (not shown) have temperature sensors and heater controls separate from modules 44, 46, 48, etc. For example, thermistor 88 is secured to heater 82 and a like thermistor 90 is secured to the heater of module 76. The heater 82 and foil layer 84 of module 72 and of the remaining modules extend beyond the region of member 30 as shown at 94, 94' in FIGS. 4 and 5, an amount sufficient for the thermistors to be secured to the heaters. The thermistors are in intimate thermal contact with the respective members 30, 34 and the respective heaters. This thermal contact minimizes thermal lag and the increase in response time. In addition, the thermistors are beyond members 30 and 34 because there is insufficient room for the thermistors inside the gap area between the porous members. In FIG. 4, both heater pairs and their thermistors are connected to control 92. Control 92 sets the temperature of module pairs (72, 74) and (76, 78) in accordance with the measured density of the film. That is, the temperature of each of the module pairs is determined separately empirically by observing the measured density of the processed film.

A thermistor, designated $T_1$ in FIG. 3, is located centrally of the processor to sense the temperature of the heater of the central most one of modules 44, 46, 48, etc. The film density is empirically established uniform to the desired degree as will be described. The temperature differences between thermistors 88 and 90 (FIG. 5) shown at $T_2$ and $T_3$, respectively, in FIG. 3, and the cental thermistor $T_1$ is then noted. These temperature differences are then maintained by control 92, FIG. 4, throughout the operation of the processor. For example, if the temperature differential between $T_1$ and $T_2$ were 10° F. for a given temperature at $T_1$, and if the differential between $T_1$ and $T_3$ were 7° F. for that temperature at $T_1$, these temperature differentials are maintained constant regardless the absolute value of the temperature at $T_1$ within its operating range, e.g., 210° F. to 320° F. The temperature of the modules pairs (72, 74) and (76, 78) may be higher than that of the mdoules 44, 46, 48, and so forth. What is important is not so much the uniformity of temperature of the porous members but the effect of their temperature on the film developing process. To this extent, the heater modules 72–78 provide additional heat to the members 30–34 at the edges of the film along the film path within the processor to overcome apparent heat loss due to the relatively large change in the gap 38' as well as the geometric discontinuities at the film edges.

In operation, the blower 60, FIG. 3, supplies pressurized air to the cap 58 which supplies pressurized air through the ducts 52, 54, 56 and so forth to the respective modules 44–48. The air under pressure enters each of chambers 62, passes through the chambers 62 entering the porous member 30 under pressure. The porous member 30 is heated by modules 44–48 to the desired temperature. The air under pressure as it passes through the pores of the member 30 receives additional heat from member 30. The air then exits the pores onto the film 12 heating the film 12 and developing the latent image thereon.

The optical density of a test film developed in the processor is examined across its width at various points along its length. If the density at the edges appears as shown in FIG. 7, control 92 is operated to raise the temperature of module pairs (72, 74) and (76, 78) which can be controlled independently of each other as pairs via their respective thermistors 88, 90. The temperatures are adjusted until a uniform optical density is produced having a maximum variation of about 0.02. At this time film to be developed is then processed.

Porous members 30 and 34 preferably are spaced 0.006 inches apart with a 0.004 inch thick film. The pressure of the air supplied from blower 60 may be at 20–30 PSI. The pressure at the air gap 38 is approximately 5–7.5 PSI under these conditions. The temperature of the porous members 30 and 34 is preferably maintained at 210°–320° F.

The heater 82 of module 72 may be foil encapsulated in 3 mil thick outer covering of thermoplastic material, such as Kapton, a trademark of the Dupont Corporation; formed of a polyimide material. The outer plate layer 84 may be 0.020 inches thick. This provides temperature uniformity across this module.

Blower 60 has provisions (not shown) for adjusting the flow rate of ambient air supplied to ducts. Porous members 30 and 34 distribute air to both sides of the film 12, the air distribution being substantially uniform over the surface of the film 12 adjacent to porous members. Controlled air flow impinges upon the film 12 with uniform distribution and after striking the film, the exhausted air freely dissipates along the film 12.

Porous members 30 and 34 are positioned such that a relatively small spacing preferably in the order of 0.001–0.002 inches is between members 30 and 34 and film 12. For such a small spacing, the air heats film 12 by conduction more than by convection.

By providing direct conductive thermal heat transfer to the porous members 30 and 34 via modules 72–78 the temperature of the air exiting onto the film 12 is more accurately controlled. The porous members serve to integrate the temperature as well as provide uniform distribution of the air under pressure to the film 12.

Thermal processor 20 may be utilized in a film development system which utilizes heat processing for image development in which it does not require liquid developing agents. At present, black-and-white film is heat developed in a "dry" heat development process and may be used in the present invention. Color film is developed at present by "wet" processes which require the application of chemical agents for image fixation. It should be understood, however, that the present invention is not limited to the processing of black-and-white film but may be utilized with any photographic film coated with a photothermally sensitized emulsion and developed in the heated gas process.

What is claimed is:

1. In a thermal processor for developing a length of film by heating the same as it passes along a path of a given width in the direction of the length dimension of the path, said processor including thermally conductive gas distribution means comprising a porous homogeneous material through the pores of which gas is distributed to the film over the width of the path, means for supplying said gas to said distribution means, first heating means for heating said distribution means over said width of said path adjacent said distribution means, the improvement comprising:

second heating means extending along the length dimension of said path, thermally conductively secured to the distribution means adjacent to and beyond the edges of said film, when the film is present in said path, for providing heat to said distribution means at the edges of said path adjacent to the edges of the film, to thereby reduce density variation in said film along the width dimension of the film.

2. The thermal processor of claim 1 wherein said second heating means includes two means for heating thermally coupled to said distribution means at the respective opposite edges of the film, each such heater means comprising a thermally conductive sheet member over a heater element, said element and sheet member being on a surface of said distribution means facing said path.

3. The thermal processor of claim 2 wherein each element and sheet member are secured recessed within said distribution means.

4. The thermal processor of claim 1 wherein said second heating means includes temperature sensing means thermally coupled to the second heating means and control means responsive to the sensed temperature for setting the temperature of said second heating means independently of the setting of the temperature of said first heating means.

5. The thermal processor of claim 1 further including a housing and gas preheat means in fluid communication with said housing for heating said gas prior to said gas passing through said gas distribution means.

6. The thermal processor of claim 1 wherein said porous gas distribution means includes materials selected from the group consisting of ceramic and graphite.

7. A thermal processor for gas heat development of a photographic image in a strip of photographic film continuously passing through the processor along the length dimension of a path of a given width comprising:

thermally conductive gas distribution means comprising porous homogeneous material whose pores distribute the gas through the material to said path over said width;

and means for thermally conductively heating said distribution means including first means for conductively heating the distribution means at the edges of the film along the length dimension of the film and second means for conductively heating the distribution means centrally of the film to reduce density variations in said developed image in said normal direction.

8. The thermal processor of claim 7 further including gas preheat means for preheating the gas prior to reaching said distribution means, said first heater means being thermally conductively secured to said porous distribution means within said path width on a side of said distribution means facing away from said path, and said second heater means being secured thermally conductively to said distribution means along the edges of and beyond said path adjacent the length dimension of said film on a side of distribution means facing said path.

* * * * *